United States Patent [19]

Stych

[11] Patent Number: 4,911,587

[45] Date of Patent: Mar. 27, 1990

[54] DRILLING MACHINES

[75] Inventor: Ralph Stych, Sheffield, England

[73] Assignee: Rotabroach Limited, Sheffield, England

[21] Appl. No.: 263,042

[22] Filed: Oct. 26, 1988

[30] Foreign Application Priority Data

Oct. 27, 1987 [GB] United Kingdom ..... 8725087

[51] Int. Cl.[4] ..... B23B 41/00

[52] U.S. Cl. ..... 408/79; 408/97; 408/99; 408/103

[58] Field of Search ..... 408/87, 92, 97, 98, 408/99, 100, 103, 108, 110, 113, 114, 712, 79; 269/94, 226, 238, 257

[56] References Cited

U.S. PATENT DOCUMENTS

| | | | |
|---|---|---|---|
| Re. 28,416 | 5/1975 | Hougen . | |
| 1,178,567 | 4/1916 | Wuerpel | 408/99 |
| 3,945,749 | 3/1976 | McIlrath | 408/95 |
| 4,474,514 | 10/1984 | Jensen | 408/72 R |
| 4,500,081 | 2/1985 | Carossino | 269/226 |
| 4,753,556 | 6/1988 | Solko | 408/108 |

FOREIGN PATENT DOCUMENTS

| | | | |
|---|---|---|---|
| 1222770 | 6/1960 | France | 269/94 |
| 593243 | 5/1959 | Italy | 408/87 |
| 14141 | of 1891 | United Kingdom | 408/99 |
| 503867 | 4/1939 | United Kingdom . | |

*Primary Examiner*—Daniel Howell

*Attorney, Agent, or Firm*—Fay, Sharpe, Beall, Fagan, Minnich & McKee

[57] ABSTRACT

A drilling machine for drilling holes in the ends of rails for a railway track to receive fishplate bolts, has a base 12 on which is provided a former 20 adapted to the profile of the rail 10. A clamping jaw 18 is connected by a clamping mechanism 16 for clamping the base 12 to the rail. An electric drill 20 is slidably supported on a column 14 on the base 12. An annular hole cutter 26 on the drill spindle 24 drills a hole through the web 40 of the rail 10. The former 30 accurately locates the drilling axis laterally with respect to the rail 10 and a respective end of the former 30 can be aligned with the rail end when clamping the machine to the rail in order that the drill axis will be accurately located longitudinally of the rail.

13 Claims, 3 Drawing Sheets

DRILLING MACHINES

The present invention relates to a drilling machine and more particularly to a machine for drilling holes in rail ends of railway tracks to receive the fishplate bolts.

In one conventional method of drilling holes in the ends of rails, the rail first has to be marked at the position where the hole is to be drilled and the machine is then clamped to the rail in alignment with this mark. The position to be drilled has to be accurate both longitudinally of the rail as measured from the rail end and laterally of the rail as measured between its flanges. Tolerances are fairly close so that positioning of the machine is time consuming and difficult, particularly as the machine is petrol driven and therefore very heavy. The machine must also be very strong to enable the reaction forces resulting from the drilling thrust to be transferred back to the rail being drilled.

U.S. Pat. No. 3,945,749 describes and illustrates a drilling machine for in situ drilling of a hole in the web of a rail for a railway track, comprising a base having a substantially horizontal column at one side thereof and having or being adapted to receive at the opposite side thereof a former shaped to be received between, and thereby located vertically by, the flanges of the rail, a clamping jaw connected to the base and displaceable by actuating means so as to engage the web of the rail opposite the former and thereby clamp the base on to the rail and a power drill mounted on the column and having a drill spindle extending substantially perpendicularly to the base such that a bit supported on the end of the spindle can be advanced towards the rail for cutting a hole through the web in the region of the base and the clamping jaw.

This machine uses a conventional twist drill and, because of the large diameter of the drill bit, the drilling machine must be powerful. It is therefore provided with an internal combustion engine as a power source. Although the drilling machine is described in U.S. Pat. No. 3,945,749 as being portable, it is extremely heavy and requires two operators to manhandle it. Also additional ground support is required for the machine because of its weight and this ground support must be adjusted before each drilling operation can commence.

It is an object of the invention to provide a rail drilling machine which is lightweight and robust and which can be used by a single operator without any assistance.

GB-A-No. 503867 describes and illustrates a rail drilling machine which is hand driven and which is fitted with an annular cutter or saw said to be like a crown bit. This hand driven machine is attached to the bottom flange of the rail and the spindle guide casing must be adjusted both horizontally and vertically before drilling.

According to the present invention, the power drill is an electric drill and the drill bit comprises an annular cutter. Also, the invention is characterised by the absence of any ground support for the machine.

The clamping jaw is preferably relieved at its portión directly aligned with the drill spindle and the cutting bit thereon in order to provide clearance for the forward end of the bit when the latter breaks through the web.

In a preferred embodiment, a clamping lever is provided and is pivotable or swingable relative to the base and the clamping jaw is mounted on the free end of the clamping lever so that, as the latter is swung by the actuating means, the clamping jaw approaches the web to be clamped.

It is advantageous for the clamping jaw to be articulated to the clamping lever. With such an arrangement there is no tendency for the clamping action to pull the former out of position. The articulation enables the clamping thrust and also the drilling reaction to be transmitted to the web perpendicularly thereto.

It is convenient for the former to be releasable from the base so that the former can be replaced. This enables the drilling machine to be used for rails of cros sections which differ both in size and in shape.

The former conveniently comprises a block having accurately formed ends so that a respective one of these ends can be aligned with the end of the rail to be drilled, whereby the hole is thereafter drilled at a precise position measured from the end of the rail. A stop can be provided on the former for positive engagement with the rail end. The stop may be retractable. If a second hole further spaced from the rail end is desired then after drilling the first hole a spacer jig can be fitted in the drilled hole and the former can then be abutted with the jig to define the position for the second hole. In the same way a third hole can be drilled further from the rail end.

The annular cutter leaves a central slug unmachined whereby the power required to drill the hole is reduced. The electric drill need only have a 1000 Watt motor when annular cutters as described in U.S. Pat. No. Re. 28,416 are used.

The use of annular cutters not only enables the power required to be reduced but also enables the drilling thrust to be reduced whereby the whole drilling machine can be made lighter and more easily portable.

The invention is further described, by way of example, with reference to the accompanying drawings, in which.

Figure 1:
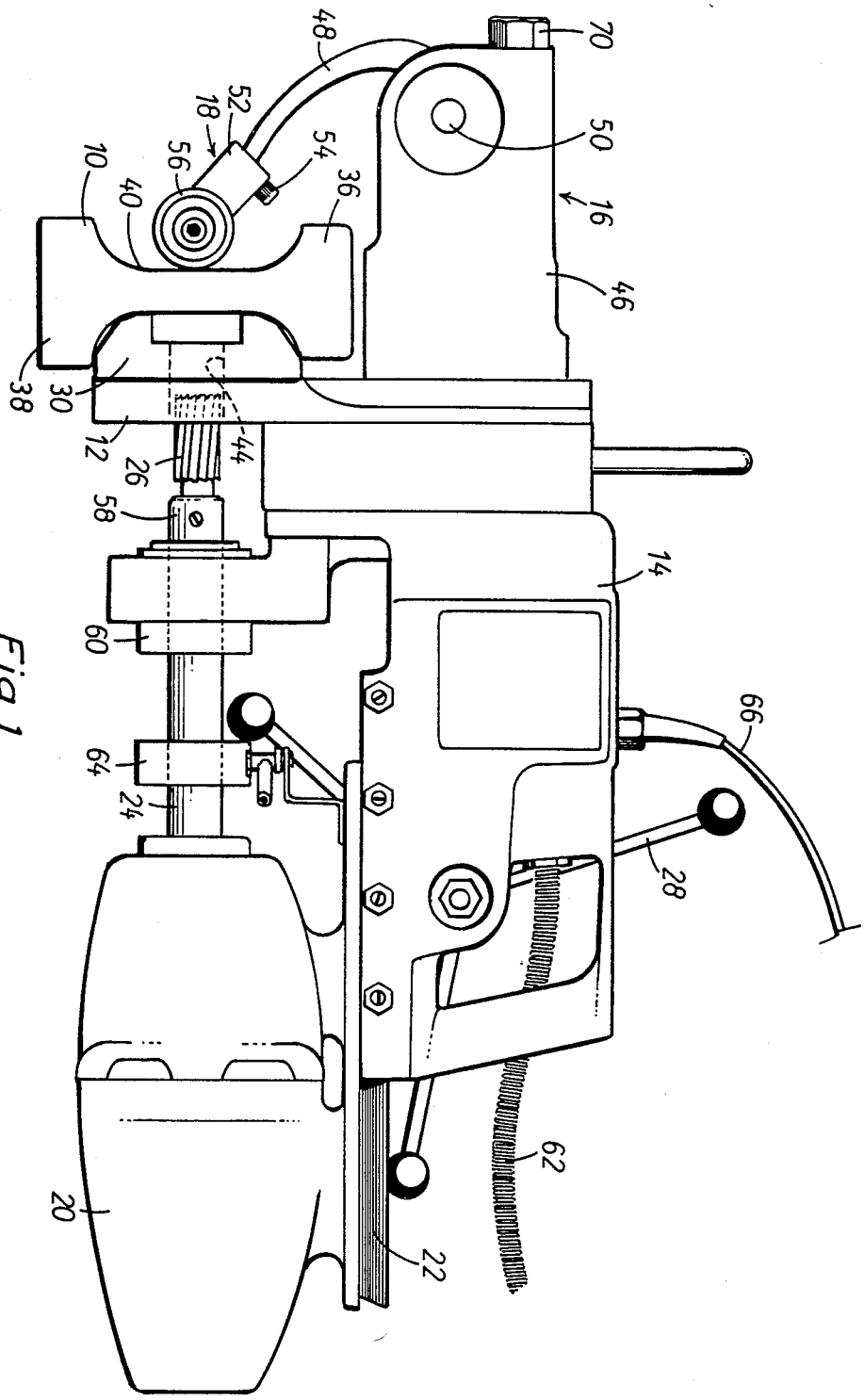
FIG. 1 is a side elevation of a portable drilling machine in accordance with one embodiment of the invention.

The drawings show a drilling machine in accordance with the invention positioned on and clamped to a rail 10 for drilling the bolt holes for fishplates. The machine comprises a base 12 with a horizontal column 14 thereon. Opposite the column 14 is a clamping mechanism 16 having a clamping jaw 18. An electric power drill 20 is mounted by a slide 22 on the column 14 and has a drill spindle 24 for supporting at its free end a drill bit 26. The column 14 has a handwheel 28 for advancing and retracting the electric drill 20 with its drill spindle 24.

A former 30 is detachably secured to the base 12 by two diametrically opposed screws 32 and is accurately located relative to the base 12 by two diametrically located dowels 34. The former 30 is accurately shaped so as to be received between and vertically located between the upper and lower flanges 36 and 38 of the rail 10. In other words the former 30 is profiled to match the profile of the rail. The former 30 thereby not only acts as a fixed counter clamping jaw but also as a jig for the accurate location of the drilling axis laterally of the rail 10 whereby the hole will be drilled centrally or otherwise as required through the web 40 of the rail.

Figure 2:
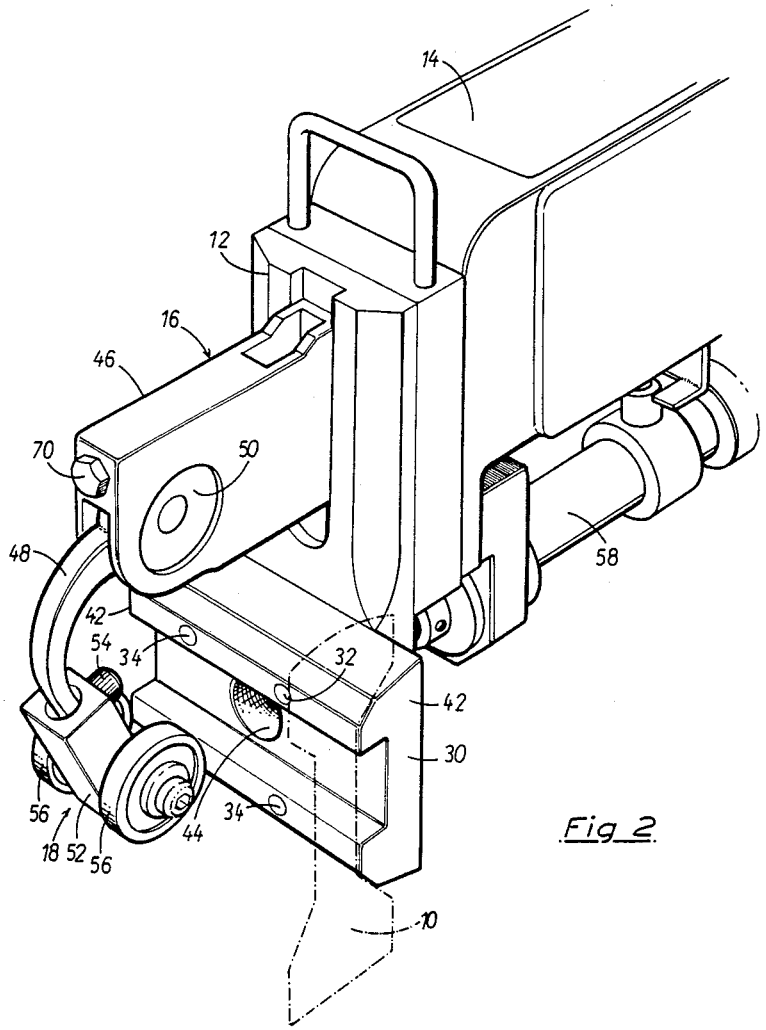
FIG. 2 is a perspective view of part of the drilling machine.

The former 30 is also made accurately to length so that one of its end faces 42 can be aligned with the end of the rail 10 as illustrated diagrammatically in FIG. 2. The hole will thereby be drilled a precise predetermined distance from the rail end well within permitted tolerances.

The clamping mechanism 16 of FIGS. 1 and 2 comprises a housing 46 attached by one end to the base 12 and having adjacent its other end a lever 48 pivotable or swingable about an axle 50. The clamping jaw 18 comprises a body 52 articulated by a pivot pin 54 to the free end of the lever 48 whereby the body 52 can swing slightly relative to the rail 10. The clamping jaw includes two spaced rollers 56 which actually engage the web 40 at spaced points on directly opposite sides of the hole to be drilled. The dimensions and particularly the length of the lever 48 are such that the centre of action of the clamping force produced by the clamping mechanism 16 is directly opposite the former 30 and substantially aligned with the drilling axis. The rollers 56 in conjunction with the pivot pin 54 ensure that the clamping action does not tend to cause the former 30 to cock over and thereby go out of position when clamping the machine to the rail. The spacing between the rollers 56 provides clearance for the drill bit 26 to break through the web 40.

Figure 3:
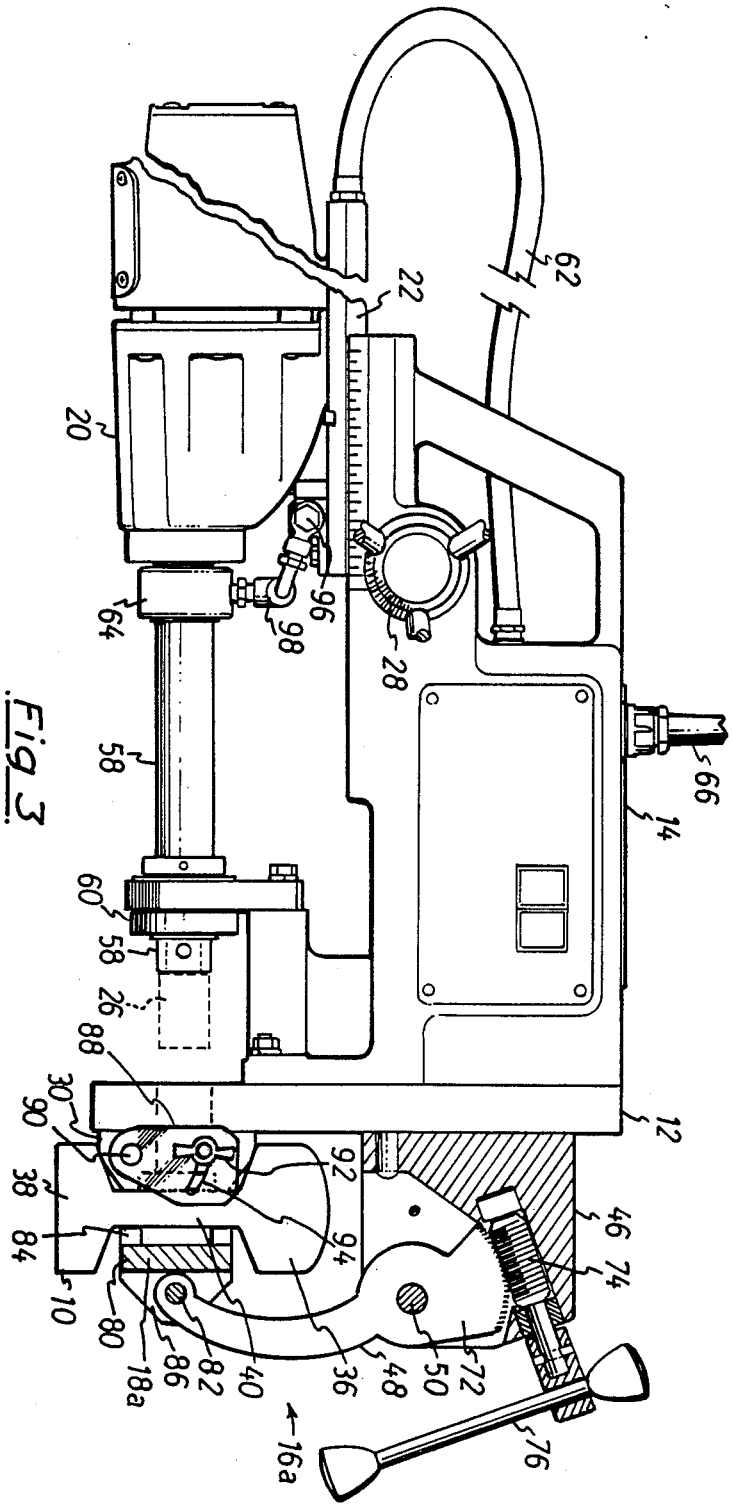
FIG. 3 is a side elevation of another embodiment of drilling machine.

As shown in FIG. 3, the clamping mechanism includes within the housing 46 an arcuate toothed member 72 to which the lever 48 is firmly attached and which is journalled in the housing 46. A worm or screw 74 meshes with its toothed periphery and in FIGS. 1 and 2 may be rotated by applying a suitable tool such as a spanner to a head 70 on the forward end of the housing 46. In FIG. 3, a forming bar 76 is used for rotating the worm 74.

In practice, the drill bit 26 is not attached directly to the spindle 24 but to an arbor 58 which is attached to the spindle 24 by a screw thread and which is slidably and rotatably recieved in a guide bush 60 attached to the lower end of the column 14.

The drill bit 26 is preferably an annular hole cutter such as one of the kind described in U.S. Pat. No. Re. 28,416. An annular hole cutter entails less metal removal than a conventional twist drill bit and thereby requires less power and a lower drilling thrust. When drilling is complete, a slug of metal remains in the annular hole cutter and this can be ejected either before or during subsequent retraction of the cutter. The annular hole cutter 26 has external flutes through which the chips can be discharged during cutting.

Since drilling is horizontal, gravity cannot be relied upon for supply of lubricant to the cutting edges of the bit 26. Therefore, a lubricant supply tube 62 leading from a pressurized container (not shown) is connected via a tap (also not shown), to a bush 64 arranged about the arbor 58, in the embodiment of FIGS. 1 and 2. This bush 64 provides communication between the tube 62 and the interior of the arbor 58 which in turn communicates with the interior of the annular hole cutter 26.

An electric power supply cable 66 is attached to the column 14 which incorporates a control box having on/off buttons on its side which is concealed in FIGS. 1 and 2 of the drawings and a further electrical connection (not shown) leads from the switches to the electric motor of the power drill 20.

In the drawings the rail 10 is illustrated as being a bull head rail. The drilling machine can be adapted for drilling rails of different weights or different kinds, such as flanged rails, merely by exchanging the former 30 for another former of suitable profile.

FIG. 2 shows the machine being set up for drilling the first hole at a predetermined distance from the end of the rail 10. When the first hole has been drilled the machine can be unclamped and moved along the rail by a suitable distance for drilling a second hole. The machine is located by the use of a jig or spacer which fits in the drilled hole and has a predetermined dimension lengthways of the rail 10 so that the end face 42 of the former 30 can be abutted with this jig or spacer to locate the drilling machine for drilling the second hole. The drilling machine can be positioned for drilling a third hole if required.

In FIG. 3, parts like those of FIGS. 1 and 2 are denoted by like reference numerals.

The clamping mechanism **16*a* of FIG. 3 differs from the clamping mechanism 16 in that the clamping jaw 18*a* comprises a solid block 80 without the rollers 56 and is pivoted to the lever 48 by a pin 82 which is parallel to the lever axle 50. The block 80 is square or rectangular and has one projection 84 at each of its four corners. The projections 84 engage the web 40 and provide the clearance for the cutter 26 to break through and for the metal slug to fall away. The block 80 also has lugs 86 which support the pivot pin 82 and between which the free end of the lever 48 extends. This allows the jaw 16*a* to tilt and thereby apply even pressure to the web 40**, whereby the clamping and drilling forces do not tend to tilt the drilling machine.

A stop plate 88 is pivotally attached by a screw 90 to one end of the former 30 in FIG. 3. It can be locked in its extended position illustrated by a wing nut 92 which is screwed on to a stud extending through an arcuate slot 94 in the stop plate 88.

In its extended position, the stop plate 88 firmly abuts the rail end to provide accurate location of the hole to be drilled by reference to the end of the rail. To drill a second hole, the stop plate 88 can be retracted upon loosening the wing nut 92. The machine can then be moved along the rail and located with reference to the hole already drilled as described previously.

In FIG. 3, the lubricant supply tube 62 is connected to one end of a bore in the slide 22. The other end of this bore is connected by a banjo coupling 96 and a bent tube 98 to the bush 64 on the arbor 58. In this embodiment, the bush 64 lies close to the drill 20, so that the drill spindle cannot be seen in FIG. 3.

Both embodiments are characterised in that the drilling machine is relatively light and the clamping mechanism 16 or **16*a*** is sufficiently strong to clamp the machine to the rail and hold it accurately in position during machining without any ground support. The machine is sufficiently light for it to be carried by one hand. It can be powered from a portable generator.

The embodiments of the invention in which an exclusive property or privelege is claimed are defined as follows:

1. A drilling machine for in situ drilling of a hole in the web of a double-flanged rail for a railroad track, comprising a base, a column at one side thereof, said base comprising at an opposite side thereof a former shaped to be received between, and thereby located laterally by, the flanges of said rail, said former comprising a body which is accurately shaped in profile so as to match a profile of the double flanged rail, and a stop means for locating one end of said body at a selected rail end; clamp means comprising a clamping jaw, means movably connecting said jaw to said base for displacement so as to engage the web of said rail opposite the former and actuating means for said clamping jaw whereby to clamp said base on to said rail; an electric power drill mounted on said column and having a drill spindle extending substantially perpendicularly to said base; and an annular cutter supported on the end of said spindle for cutting a hole through the web of said rail in the region of the base and the clamping jaw; the strength of said clamping jaw, said connecting means, said actuating means, said base and said former being so chosen in relation to the weight of said drilling machine and the power of said power drill that said clamp means is sufficient in itself to maintain said drilling machine in position during drilling.

2. A drilling machine for in situ drilling of a hole in the web of a double-flanged railroad track, comprising a base; a column at one side thereof, said base comprising at an opposite side thereof a former shaped to be received between, and thereby located laterally by, the flanges of said rail, said former comprising a body which is accurately shaped in profile so as to match a profile of the double flanged rail, and a stop means located on one end of said body for positively engaging a rail end; clamp means comprising a clamping jaw, means movably connecting said jaw to said base for displacement so as to engage the web of said rail opposite the former and actuating means for said clamping jaw whereby to clamp said base on to said rail; an electric power drill mounted on said column and having a drill spindle extending substantially perpendicularly to said base; and an annular cutter supported on the end of said spindle for cutting a hole through the web of said rail in the region of the base and the clamping jaw; said former and said clamp means comprising the sole means of mounting said drilling machine.

3. A drilling machine for in-situ drilling of a hole in the web of a double-flanged rail for a railroad track, comprising a base, a column at one side thereof, said base comprising at an opposite side thereof a former shaped to be received between, and thereby located laterally by, the flanges of said rail, said former comprising a body which is accurately shaped in profile so as to match a profile of the double flanged rail, said body having first and second ends, and a stop member located on one of said body first and second ends for locating said body at a selected rail end, a clamping jaw, means movably connecting said jaw to said base for displacement so as to engage the web of the rail opposite the former, actuating means for said clamping jaw whereby to clamp said base on to said rail, an electric power drill mounted on said column and having a drill spindle extending substantially perpendicularly to said base, and an annular cutter supported on the end of said spindle for cutting a hole through the web of said rail in the region of the base and the clamping jaw.

4. A drilling machine according to claim 1, in which said base and said former thereon have a hole through which said annular cutter can pass with clearance so as to engage and penetrate the web of said rail.

5. A drilling machine according to claim 3, in which said clamping jaw has a relieved portion directly aligned with said drill spindle, whereby said annular cutter can break through the web without contacting the jaw.

6. A drilling machine according to claim 5, in which clearance is provided at said clamping jaw sufficient to enable a remaining central slug to be discharged from the cut hole when ejected from said annular cutter.

7. A drilling machine according to claim 3, in which said means movably connecting said clamping jaw to said base comprises a clamping lever which is pivotable relative to said base.

8. A drilling machine according to claim 3, in which said actuating means comprises a worm mechanism for pivoting said lever.

9. A drilling machine according to claim 1, in which the said former is detachable from said base and so can be replaced by another former which is suited to a rail of different cross-section.

10. A drilling machine according to claim 3, in which said first and second ends are adapted to be aligned with an end of said rail for drilling a hole in the web of the rail at a predetermined distance from said end thereof.

11. A drilling machine according to claim 3 further comprising a locking device for locking said stop member in an extended position.

12. A drilling machine according to claim 3, in which said stop member is retractable.

13. A drilling machine according to claim 2, in which said power drill is slidably mounted on said column for advancing and retracting the drill spindle.

* * * * *